US010399207B2

(12) United States Patent
Akashi et al.

(10) Patent No.: US 10,399,207 B2
(45) Date of Patent: Sep. 3, 2019

(54) POLISHING BRUSH

(71) Applicants: TAIMEI CHEMICALS CO., LTD., Nagano (JP); XEBEC TECHNOLOGY CO., LTD., Tokyo (JP)

(72) Inventors: Mitsuhisa Akashi, Nagano (JP); Norihiko Sumiyoshi, Tokyo (JP)

(73) Assignees: TAIMEI CHEMICALS CO., LTD., Nagano (JP); XEBEC TECHNOLOGY CO., LTD., Tokyo (JP)

( * ) Notice: Subject to any disclaimer, the term of this patent is extended or adjusted under 35 U.S.C. 154(b) by 4 days.

(21) Appl. No.: 15/521,264

(22) PCT Filed: Oct. 27, 2014

(86) PCT No.: PCT/JP2014/078530
§ 371 (c)(1),
(2) Date: Apr. 21, 2017

(87) PCT Pub. No.: WO2016/067345
PCT Pub. Date: May 6, 2016

(65) Prior Publication Data
US 2017/0304997 A1 Oct. 26, 2017

(51) Int. Cl.
*B24D 13/10* (2006.01)
*B24D 13/14* (2006.01)
*B24D 9/00* (2006.01)

(52) U.S. Cl.
CPC ..... *B24D 13/10* (2013.01); *B24D 9/003* (2013.01); *B24D 13/14* (2013.01); *B24D 13/145* (2013.01)

(58) Field of Classification Search
CPC ..... B24D 13/04; B24D 13/045; B24D 13/06; B24D 13/10; B24D 13/14; B24D 13/145;
(Continued)

(56) References Cited

U.S. PATENT DOCUMENTS 3,699,727 A * 10/1972 McDonald ..... B24D 11/00 451/466
4,200,965 A 5/1980 Roth
(Continued)

FOREIGN PATENT DOCUMENTS

CN 1615208 A 5/2005
CN 101384399 A 3/2009
(Continued)

OTHER PUBLICATIONS

International Search Report for PCT/JP2014/078530, dated Jan. 6, 2015.
(Continued)

*Primary Examiner* — Eileen P Morgan

(57) ABSTRACT

A polishing brush (4) includes a grinding element bundle (9) formed with a plurality of wire-shaped grinding elements (28) formed by impregnating and solidifying an assembly of inorganic filaments with resin, and a grinding element holder (7) having a holding hole (20) holding the base end portion of the grinding element bundle 9 on an outer peripheral side surface (7*c*) serving as a grinding element-holding surface. The grinding element bundle (9) has a front surface (9*a*) facing forward in a rotational direction (R1) and a back surface (9*b*) facing backward. The grinding element bundle (9) is held in the grinding element holder (7) such that the front surface (9*a*) and the back surface (9*b*) are inclined in the same direction relative to a virtual surface (30) that includes a center point (P) of a cross section (9*d*) of the grinding element bundle (9) cut across an outer peripheral side surface (7*c*) and the axis of center of rotation (L) of the grinding element holder (7) and extends in a radial direction. The wire-shaped grinding elements (28) included in the grinding element bundle (9) are easily displaced and can release excessive force applied thereto.

7 Claims, 17 Drawing Sheets

(58) Field of Classification Search
CPC . B24D 9/003; B24D 9/04; B24D 9/08; B24D 9/085
USPC ..... 451/532, 496, 498, 502
See application file for complete search history.

(56) References Cited

U.S. PATENT DOCUMENTS

| | | | | | |
|---|---|---|---|---|---|
| 4,646,479 | A | 3/1987 | Walker et al. | | |
| 4,907,378 | A * | 3/1990 | Huppert | B24D 13/06 | 451/463 |
| 5,438,728 | A * | 8/1995 | Kubes | A46B 9/02 | 15/180 |
| 6,471,575 | B1 * | 10/2002 | Hotani | A46B 13/003 | 451/342 |
| 6,592,442 | B2 * | 7/2003 | Hoffheimer | B24D 13/045 | 248/231.81 |
| 6,669,531 | B1 * | 12/2003 | Shaffer | B24B 3/00 | 451/10 |
| 6,866,572 | B1 * | 3/2005 | Wendt-Ginsberg | B24D 13/14 | 451/465 |
| 6,949,019 | B2 * | 9/2005 | Wentworth | B24D 5/06 | 451/466 |
| 9,199,613 | B2 * | 12/2015 | Belanger | A46B 13/001 | |
| D811,092 | S * | 2/2018 | Akashi | D4/102 | |
| 2002/0086631 | A1 * | 7/2002 | Hoffheimer | B24D 13/045 | 451/466 |
| 2003/0092370 | A1 * | 5/2003 | Lundum | A46B 3/02 | 451/466 |
| 2005/0153642 | A1 * | 7/2005 | Matsushita | A46B 13/008 | 451/526 |
| 2005/0282478 | A1 * | 12/2005 | Hoffheimer | B24D 13/06 | 451/466 |
| 2008/0200106 | A1 * | 8/2008 | Linnenbrink | B24D 13/06 | 451/548 |
| 2010/0041324 | A1 * | 2/2010 | Shinoda | B24B 29/005 | 451/466 |
| 2010/0154153 | A1 * | 6/2010 | Hooper | A46B 3/10 | 15/104.05 |
| 2016/0016293 | A1 * | 1/2016 | Matsushita | A46D 1/00 | 451/532 |
| 2017/0203736 | A1 * | 7/2017 | Belanger | A46B 7/10 | |

FOREIGN PATENT DOCUMENTS

| | | | |
|---|---|---|---|
| CN | 102216031 | A | 10/2011 |
| EP | 1543924 | A1 | 6/2005 |
| GB | 2221472 | A | 2/1990 |
| JP | H02-124273 | A | 5/1990 |
| JP | H03-029260 | U | 3/1991 |
| JP | H08-229831 | A | 9/1996 |
| JP | H09-085633 | A | 3/1997 |
| JP | 2007-245279 | A | 9/2007 |
| JP | 2008-213126 | A | 9/2008 |
| JP | 2009-0050967 | A | 3/2009 |
| JP | 2011-115905 | A | 6/2011 |
| WO | 2004/009293 | A1 | 1/2004 |
| WO | 2007/097115 | A1 | 8/2007 |
| WO | 2008/035383 | A1 | 3/2008 |
| WO | 2010/028255 | A1 | 3/2010 |
| WO | 2014/136954 | A1 | 9/2014 |

OTHER PUBLICATIONS

Written Opinion of the International Searching Authority for PCT/JP2014/078530, dated Jan. 6, 2015.
Japan Patent Office, Office Action for Japanese Patent Application No. 2016-556067, dated Oct. 2, 2018.
The State Intellectual Property Office of People's Republic of China, Office Action for Chinese Patent Application No. 201480082948.4, dated Aug. 20, 2018.
The State Intellectual Property Office of People's Republic of China, Search Report for Chinese Patent Application No. 201480082948.4, dated Aug. 10, 2018.

* cited by examiner

POLISHING BRUSH

FIELD

The present invention relates to a polishing brush including a bundle of wire-shaped grinding elements formed by impregnating and solidifying an assembly of inorganic filaments with resin.

BACKGROUND

Patent Literature 1 describes a polishing brush in which a grinding element bundle formed with a plurality of wire-shaped grinding elements protrudes from the end surface in the direction of the axis of center of rotation or protrudes from the outer peripheral surface of the grinding element holder. Each of the wire-shaped grinding elements in this literature is formed by impregnating and hardening an assembly of alumina fibers, silicon carbide fibers, carbon fibers, silicon nitride fibers or glass fibers with binder resin. The wire-shaped grinding element composed of inorganic filaments has high hardness and thus has high grinding/polishing capability.

CITATION LIST

Patent Literature

Patent Literature 1: WO2007/097115

SUMMARY

Technical Problem

In the polishing brush including a grinding element bundle formed with wire-shaped grinding elements composed of inorganic filaments, when the grinding element bundle becomes short due to wear, the wire-shaped grinding elements become so strong that the wire-shaped grinding elements easily break during grinding/polishing work.

In view of the foregoing, the problem to be solved by the present invention is to provide a polishing brush in which breaking of the wire-shaped grinding elements during work can be suppressed.

Solution to Problem

In order to solve the problem above, the present invention provides a polishing brush including a grinding element bundle formed with a plurality of wire-shaped grinding elements formed by impregnating and solidifying an assembly of inorganic filaments with resin, and a grinding element holder holding a base end portion of the grinding element bundle in a holding hole on a grinding element bundle-holding surface, characterized in that the grinding element bundle has a front surface facing forward in a rotational direction, the front surface being inclined relative to a virtual surface that includes a center point of a cross section of the grinding element bundle cut across the grinding element bundle-holding surface and an axis of center of rotation of the grinding element holder and extends in a radial direction.

In the present invention, when the polishing brush is rotated and the tip end of the grinding element bundle is pressed against a workpiece, the wire-shaped grinding elements included in the grinding element bundle are easily displaced, compared with a case in which the front surface of the grinding element bundle is not inclined relative to the virtual surface. Therefore, when excessive force is applied to the wire-shaped grinding elements, the force can be released. This can suppress the breaking of the wire-shaped grinding elements during work.

In the present invention, the grinding element bundle-holding surface may face toward an outer periphery.

In this case, the cross section of the grinding element bundle may have a flattened shape that has a smaller thickness dimension in the rotational direction than a height in the direction of the axis of center of rotation, and the front surface may be inclined in the rotational direction from one side toward the other side in the direction of the axis of center of rotation. With this configuration, when the polishing brush is rotated and the tip end of the grinding element bundle is pressed against a workpiece, the wire-shaped grinding elements are easily displaced in the direction of the axis of rotation and in the rotational direction. Here, the flattened shape includes a rectangle and an oval. When the cross section of the grinding element bundle has an oval shape, the state in which the front surface of the grinding element bundle is inclined relative to the virtual surface refers to a state in which the longer axis of the oval cross section is inclined relative to the virtual surface whereby the front surface is inclined.

In the present invention, the front surface may be inclined backward in the rotational direction from an inner periphery toward an outer periphery. With this configuration, when the polishing brush is rotated and the tip end of the grinding element bundle is pressed against a workpiece, the wire-shaped grinding elements are easily displaced backward in the rotational direction.

In the present invention, the grinding element bundle-holding surface may face in the direction of the axis of center of rotation.

In this case, the cross section of the grinding element bundle may have a flattened shape that has a smaller thickness dimension in the rotational direction than a length in the radial direction, and the front surface may be inclined in the rotational direction from an inner periphery toward an outer periphery. With this configuration, when the polishing brush is rotated and the tip end of the grinding element bundle is pressed against a workpiece, the wire-shaped grinding elements are easily displaced toward the outer periphery and backward in the rotational direction. Here, the flattened shape includes a rectangle and an oval. When the cross section of the grinding element bundle has an oval shape, the state in which the front surface of the grinding element bundle is inclined relative to the virtual surface refers to a state in which the longer axis extending from the inner periphery toward the outer periphery in the oval cross section is inclined relative to the virtual surface whereby the front surface is inclined.

In this case, the front surface may be inclined backward in the rotational direction as a distance from the grinding element holder increases in the direction of the axis of center of rotation. With this configuration, when the polishing brush is rotated and the tip end of the grinding element bundle is pressed against a workpiece, the wire-shaped grinding elements are easily displaced backward in the rotational direction.

In the present invention, it is preferable that the grinding element holder be made of resin. With this configuration, the flexibility of resin can absorb excessive force applied to the wire-shaped grinding elements. Therefore, compared with a case in which the inner peripheral end portions of the wire-shaped grinding elements are held by a grinding element holder made of metal, the breaking of the wire-shaped grinding elements can be suppressed during work.

In the present invention, it is preferable that the polishing brush include a plurality of the grinding element bundles, the grinding element holder have a plurality of the holding holes holding the grinding element bundles and a coupling hole connecting the holding holes in a circumferential direction, and each of the grinding element bundles of the wire-shaped grinding elements be fixed to the grinding element holder with an adhesive injected in the corresponding holding hole and the coupling hole. With this configuration, the grinding element bundles inserted in the adjacent holding holes can be affixed with each other with the adhesive filling the coupling hole. This ensures that the grinding element bundles are fixed to the grinding element holder. Since the fixing of the grinding element bundle to the grinding element holder is ensured, the depth dimension of the holding hole can be reduced. Therefore, in the case of a polishing brush in which the grinding element bundle protrudes from the grinding element holder toward the outer periphery, the size of the grinding element holder can be reduced in the radial direction, and the diameter of the polishing brush can be reduced. When the polishing brush has the same outer diameter dimension as conventional ones, the length of the grinding element bundle (the wire-shaped grinding elements) can be increased, thereby suppressing the breaking of the wire-shaped grinding elements during work. Similarly, in the case of a polishing brush in which the grinding element bundle protrudes from the grinding element holder in the direction of the axis of center of rotation, the height of the grinding element holder can be reduced, and the size of the polishing brush can be reduced. When the polishing brush has the same height as conventional ones, the length of the grinding element bundle (the wire-shaped grinding elements) can be increased, thereby suppressing the breaking of the wire-shaped grinding elements during work.

In this case, it is preferable that an inner peripheral surface of the holding hole have projections and depressions. With this configuration, the anchor effect brought about by the projections and depressions further ensures the fixing of the grinding element bundle to the grinding element holder with an adhesive.

In the present invention, it is preferable that the polishing brush include a shank removably attached to the grinding element holder. With this configuration, when the wire-shaped grinding elements are worn, the grinding element holder with the grinding element bundles alone can be replaced with a new one, whereas the shank serving as a mount for a machine tool can be reused. A plurality of shanks with different lengths may be prepared so that, by selecting any one of the shanks, it is possible to adjust the position of the grinding element bundle relative to the head when the polishing brush is coupled to the head of a machine tool.

DESCRIPTION OF EMBODIMENTS

Figure 1A:
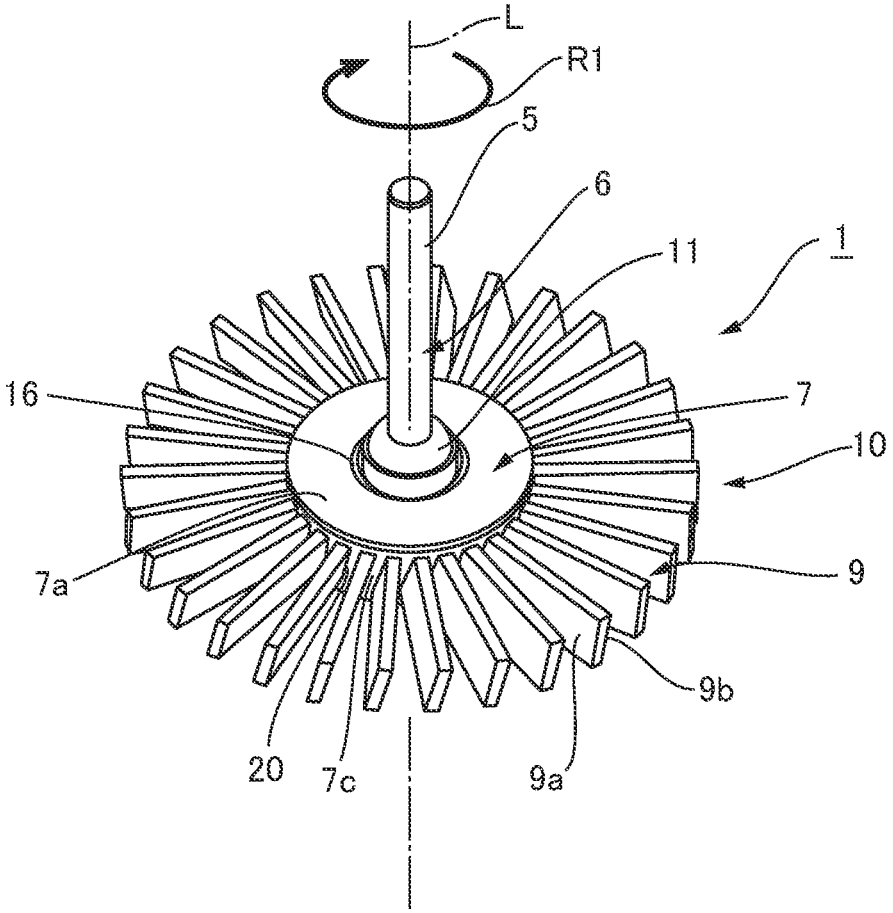
FIG. 1 is a perspective view of a polishing brush in a first embodiment.

The polishing brush that the present invention is applied to will be described below with reference to the drawings. In the following description, it is assumed that the top-bottom in the drawings is the top-bottom of the polishing brush for the sake of convenience.

(First Embodiment)

Figure 1B:
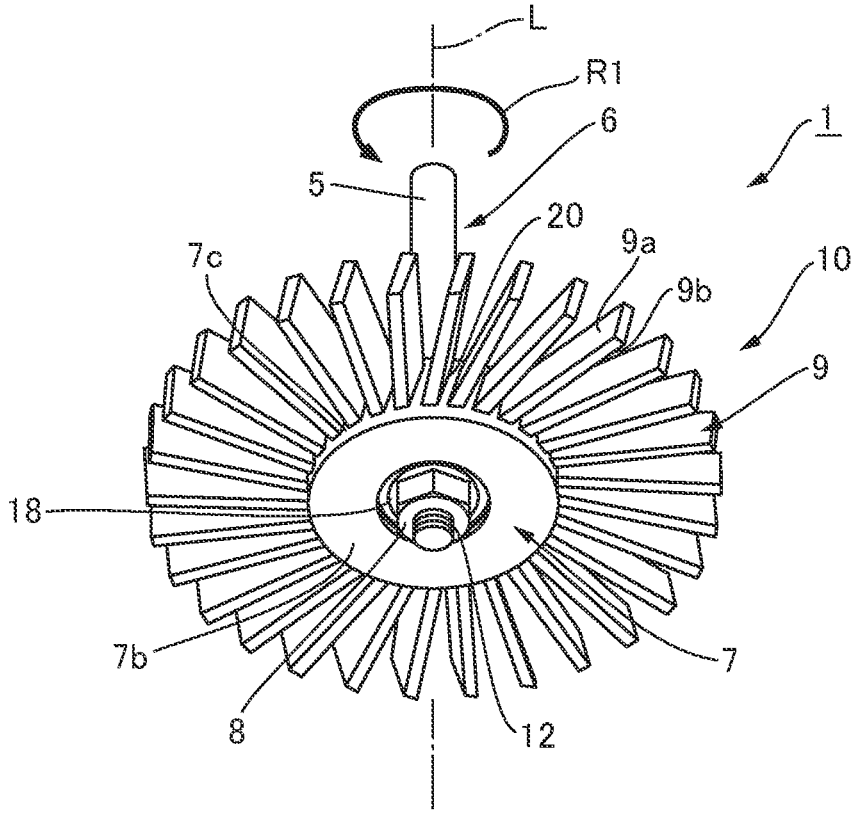
Figure 2A:
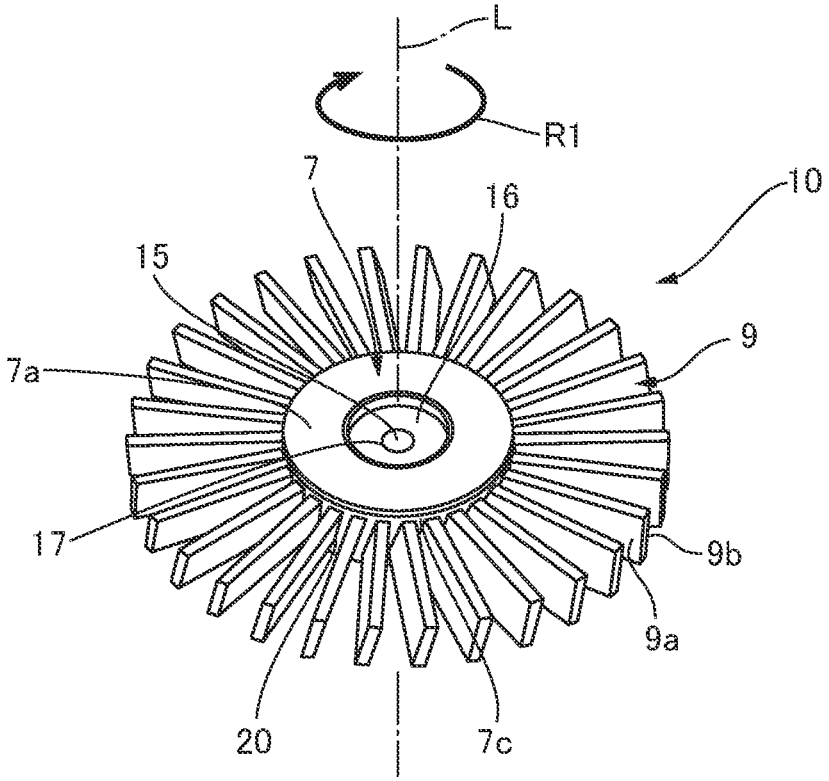
FIG. 2 is an illustration of a brush body and a grinding element holder.
Figure 2B:
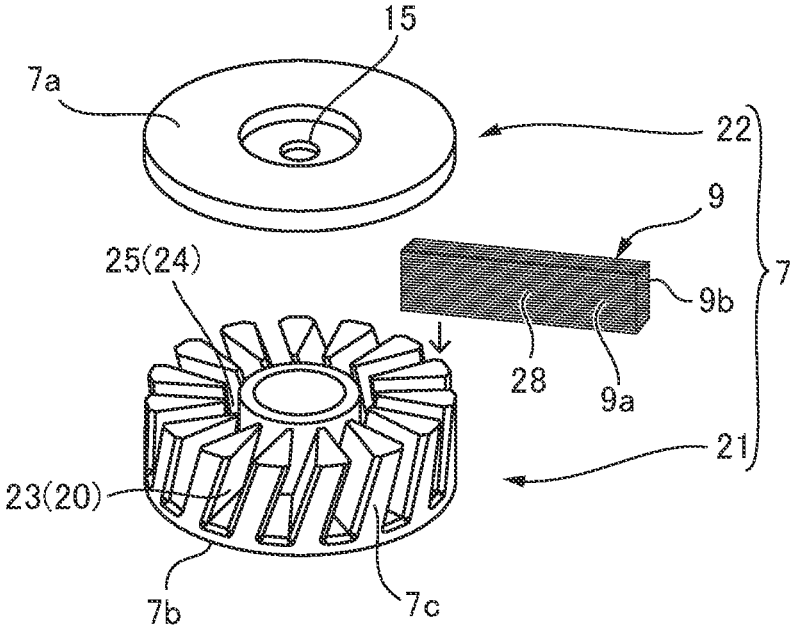

FIG. 1(*a*) is a perspective view of a polishing brush according to a first embodiment of the present invention as viewed diagonally from above and FIG. 1(*b*) is a perspective view of the polishing brush as viewed diagonally from below. FIG. 2(*a*) is a perspective view of the brush body as viewed diagonally from above and FIG. 2(*b*) is an exploded perspective view of the brush body.

As shown in FIG. 1, the polishing brush 1 includes a shank member 6 having a shank portion (shank) 5 coupled to the head of a machine tool (drive device), an annular grinding element holder 7 through which the lower portion of the shank member 6 passes, and a locknut 8 screwed on the lower end portion of the shank member 6. A plurality of grinding element bundles 9 protrude from the grinding element holder 7 toward the outer periphery. The grinding element holder 7 and the grinding element bundles 9 constitute the brush body 10.

The shank member 6 is made of metal and includes a shank portion 5, a collar 11, and a bolt 12 from the top to the bottom. The bolt 12 has the same outer diameter dimension as the shank portion 5 and has a male thread on its outer peripheral surface to be screwed in the locknut 8. The collar 11 stretches out toward the outer periphery from the shank portion 5 and the bolt 12. The portion below the collar 11 of the shank member 6 is inserted into the center hole 15 (see FIG. 2(*a*)) of the grinding element holder 7, and the lower end portion of the bolt 12 protrudes downward from the grinding element holder 7.

The grinding element holder 7 is made of resin. In the present embodiment, the grinding element holder 7 is made of ABS resin. The upper end surface 7*a* of the grinding element holder 7 has an upper circular concave portion 16 at its central portion. The upper circular concave portion 16 is recessed downward in the axial direction. As shown in FIG. 2(*a*), an upper end opening 17 of the center hole 15 of the grinding element holder 7 is formed at the central portion of the bottom surface of the upper circular concave portion 16. As shown in FIG. 1(*b*), the lower end surface 7*b* of the grinding element holder 7 has a lower circular concave portion 18 at its central portion. The lower circular concave portion 18 is recessed upward in the axial direction. A lower end opening (not shown) of the center hole 15 of the grinding element holder 7 is formed at the central portion of the bottom surface of the lower circular concave portion 18. The annular outer peripheral side surface 7*c* of the grinding element holder 7 serves as a grinding element-holding surface. On the outer peripheral side surface 7*c*, a plurality of holding holes 20 for holding the grinding element bundles 9 are formed at regular angular intervals in an annular shape. When the grinding element holder 7 is viewed from the radial direction, each of the holding holes 20 is shaped in a flat parallelogram longer in the direction of the axis of center of rotation L and shorter in the circumferential direction and is inclined relative to the axis of center of rotation L. The grinding element holder 7 has a rotation-symmetric shape that is identical when turned upside down.

As shown in FIG. 2(*b*), the grinding element holder 7 includes a holder body 21 and a cover 22 put on the holder body 21 from above and fixed to the holder body 21 with an adhesive. The holder body 21 has a plurality of holding grooves 23 to serve as holding holes 20 when covered with the cover 22. Each of the holding grooves 23 (holding hole 20) extends in the radial direction. The holder body 21 also has an annular coupling groove 25, which connect the inner peripheral end portions of the holding grooves 23. The coupling groove 25 is provided concentrically with the center hole 15 in the grinding element holder 7. When the cover 22 is put on the holder body 21, the coupling groove 25 serves as an annular coupling hole 24. The holding grooves 23 (holding holes 20) and the coupling groove 25 (coupling hole 24) have the same height. The holding holes 20 and the coupling hole 24 have minute protrusions and depressions on their inner wall surfaces.

As shown in FIG. 2(*b*), each of the grinding element bundles 9 is formed by bundling a number of wire-shaped grinding elements 28 with the same length. Each of the wire-shaped grinding elements 28 is formed by impregnating and hardening an assembly of alumina filaments as inorganic filaments with thermosetting binder resin such as silicone resin, phenol resin, epoxy resin, polyimide resin, polymaleimide resin, unsaturated polyester resin, and urethane resin, or thermoplastic resin such as nylon. In the present embodiment, the filament assembly is a group of 250 to 3000 alumina filaments with a fiber diameter of 8 μm to 50 μm. The diameter of the filament assembly is 0.1 mm to 2 mm. The filament assembly may be twisted.

The inner peripheral end portion of the grinding element bundle 9 is inserted in a certain holding hole 20 and fixed to the grinding element holder 7 with an adhesive.

When the grinding element bundles 9 are fixed to the holding holes 20, the holding grooves 23 and the coupling groove 25 in the holder body 21 are filled with an adhesive. An adhesive is applied also on the upper end surface of the holder body 21. For example, a silicone resin-based or epoxy resin-based adhesive may be used. Concurrently, the wire-shaped grinding elements 28 with the identical length are held in the form of a bundle such that its cross-sectional shape is a parallelogram, using a jig or the like (not shown).

Next, the wire-shaped grinding elements 28 are inserted into the holding groove 23 filled with an adhesive. For example, as shown by the arrow in FIG. 2(*b*), the inner peripheral end portions of the wire-shaped grinding elements 28 are inserted into the holding groove 23 from above. Subsequently, the cover 22 is put on the holder body 21 and the adhesive is hardened. In this way, while the grinding element bundle 9 is formed, the inner peripheral end portion of this grinding element bundle 9 is fixed to the grinding element holder 7. The wire-shaped grinding elements 28 (grinding element bundle 9) may be inserted into the holding groove 23 from the outer periphery of the holder body 21.

Figure 3:
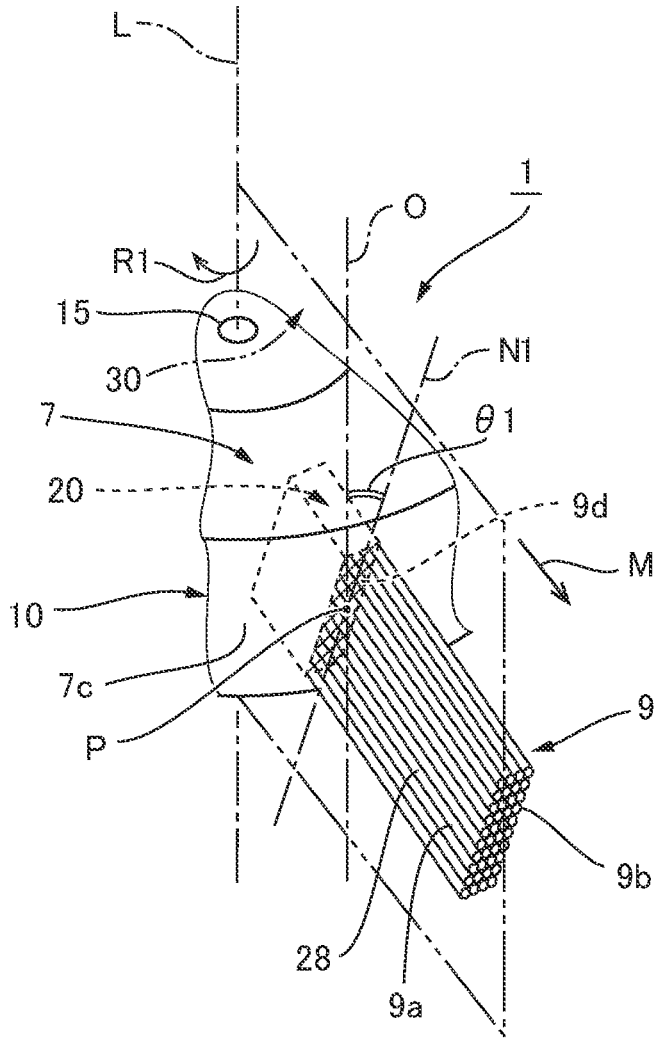
FIG. 3 is a partial enlarged view of the brush body.

Inserting the grinding element bundle 9 into the holding hole 20 allows the grinding element bundle 9 to have a cross-sectional shape corresponding to the cross-sectional shape of the holding hole 20. That is, the grinding element bundle 9 has a parallelogrammatic shape in cross section and has a front surface 9*a* facing forward in the rotational direction R1 and a back surface 9*b* facing backward. FIG. 3 is a partial enlarged view of the brush body. In FIG. 3, the coupling hole 24 is not shown to facilitate understanding of the shape of the holding hole 20.

As shown in FIG. 3, the front surface 9*a* and the back surface 9*b* each extend along the wire-shaped grinding element 28 from the inner periphery to the outer periphery and extend in the top-bottom direction. The front surface 9*a* and the back surface 9*b* are parallel to each other, and the thickness dimension of the grinding element bundle 9 is constant in the circumferential direction. The cross-sectional shape (the cross-sectional shape orthogonal to the direction in which the wire-shaped grinding elements 28 extend) of the grinding element bundle 9 is a flattened shape that has a smaller thickness dimension in the circumferential direction than the height in the direction of the axis of center of rotation L.

The grinding element bundle 9 is inclined from one side toward the other side in the direction of the axis of center of rotation L by a predetermined inclination angle θ1, relative to a virtual surface 30 that includes the center point P of a cross section 9*d* of the grinding element bundle 9 cut across the grinding element bundle-holding surface (outer peripheral side surface 7*c*) and the axis of center of rotation L and extends in the radial direction M orthogonal to the axis of center of rotation L. In other words, the grinding element bundle 9 is inclined such that the center line N1 of the grinding element bundle 9 passing through the center point P and extending in the middle between the front surface 9*a* and the back surface 9*b* from the top to the bottom is inclined relative to the virtual surface 30 (relative to a virtual line O passing through the center point P on the virtual surface 30 and extending in the direction of the axis of center of rotation L) by the inclination angle θ1. Therefore, the front surface 9*a* and the back surface 9*b* of the grinding element bundle 9 are also inclined relative to the virtual surface 30 in the rotational direction R1 from one side toward the other side in the direction of the axis of center of rotation L. In the present embodiment, the inclination angle θ1 is 30°.

The locknut 8 is screwed from below onto the lower end portion of the bolt 12 protruding downward from the grinding element holder 7. The locknut 8 is screwed on the bolt 12 until the locknut 8 and the collar 11 of the shank member 6 sandwich the grinding element holder 7 from opposite sides in the direction of the axis of center of rotation L. The grinding element holder 7 is thus fixed to the shank member 6. In a state in which the grinding element holder 7 is mounted on the shank member 6, the lower end portion of the collar 11 is inserted in the upper circular concave portion 16, and the lower surface of the collar 11 abuts on the concave bottom surface. The upper end portion of the setscrew is inserted in the lower circular concave portion 18, and the upper surface of the screw abuts on the concave bottom surface.

(Work Operation)

Figure 4:
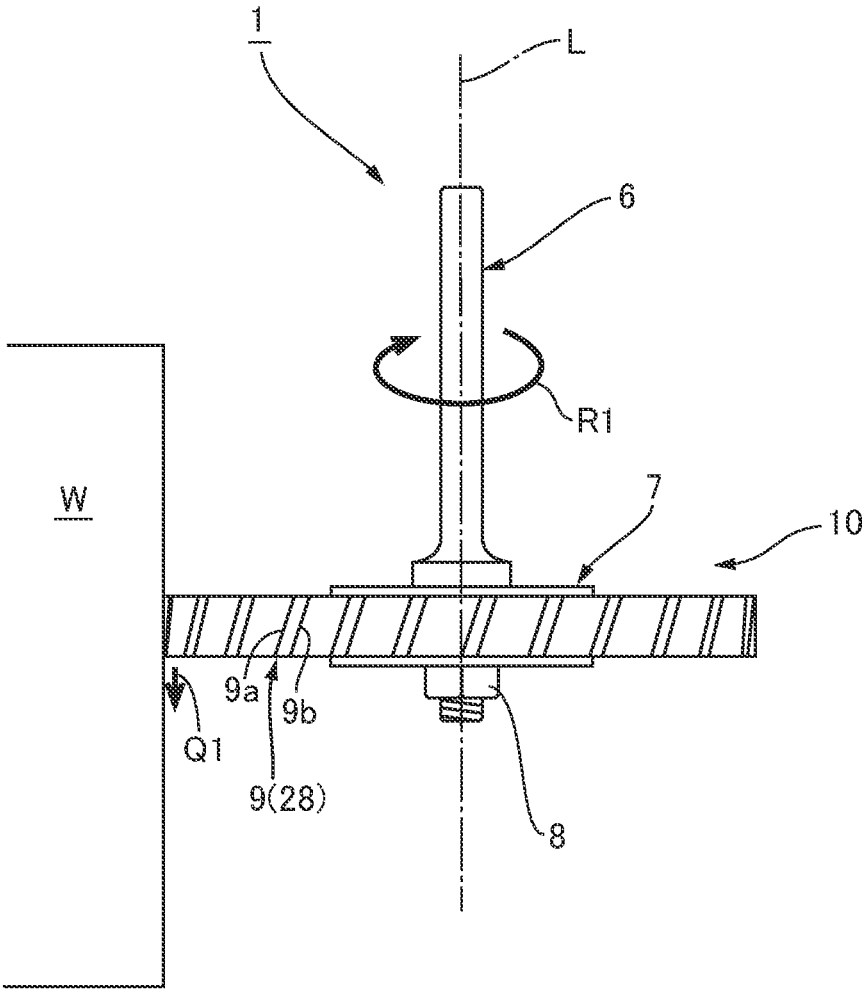
FIG. 4 is an illustration of work operation by the polishing brush in the first embodiment.

FIG. 4 is an illustration of work operation by the polishing brush 1 in the present embodiment. When burring or grinding/polishing work on a surface is performed on a workpiece W using the polishing brush 1, the shank portion 5 is coupled to the head of a machine tool and rotated around the axis of center of rotation L, and the tip end (the end on the outer periphery) of the grinding element bundle 9 (wire-shaped grinding elements 28) is pressed against the surface of the workpiece W.

Here, in the polishing brush 1 in the present embodiment, the end surfaces (the front surface 9*a* and the back surface 9*b*) facing in the circumferential direction in the grinding element bundle 9 are inclined relative to the virtual surface 30 including the axis of center of rotation L. Therefore, compared with a case in which the end surfaces 9*a* and 9*b* are parallel to the virtual surface 30 (orthogonal to the rotational direction R1), the wire-shaped grinding elements 28 included in the grinding element bundle 9 are easily displaced in the direction of the axis of center of rotation L (the direction shown by the arrow Q1 in FIG. 4: downward) when the polishing brush 1 is rotated and the tip end of the grinding element bundle 9 is pressed against the workpiece W. Therefore, when excessive force is applied to the wire-shaped grinding elements 28, the force can be released. This can suppress the breaking of the wire-shaped grinding elements 28.

In the present embodiment, when the polishing brush 1 is rotated and the tip end of the grinding element bundle 9 is pressed against the workpiece W, the wire-shaped grinding elements 28 included in the grinding element bundle 9 are displaced in the direction of the axis of center of rotation L, and this displacement improves the grinding/polishing capability.

The inclination angle θ1 relative to the virtual surface 30 of the center line N1 of the grinding element bundle 9 passing through the center point P and extending from the top to the bottom in the middle between the front surface 9*a* and the back surface 9*b* is preferably in the range of 15° or more to 60° or less. With this range of the inclination angle θ1, it is possible to suppress breaking of the wire-shaped grinding element 28 while suppressing reduction in contact surface of the grinding element bundle 9 on the workpiece W.

In the present embodiment, since the grinding element holder 7 holding the inner peripheral end portion of the grinding element bundle 9 is made of resin, the flexibility of the resin can absorb excessive force applied to the wire-shaped grinding elements 28. Therefore, compared with a case in which the inner peripheral end portions of the wire-shaped grinding elements 28 are held by a metal grinding element holder 7, the breaking of the wire-shaped grinding elements 28 can be suppressed during work.

In the present embodiment, the adjacent grinding element bundles 9 are affixed to each other with an adhesive injected to the coupling hole 24. This ensures that the grinding element bundles 9 are fixed to the grinding element holder 7. In addition, since the inner peripheral surfaces of the holding holes 20 and the coupling hole 24 to be filled with an adhesive have projections and depressions, the anchor effect ensures that the grinding element bundles 9 are fixed to the grinding element holder 7. As a result, the radial dimension of the holding hole 20 can be reduced, so that the grinding element holder 7 can be reduced in the radial direction. Thus, the size of the polishing brush 1 can be reduced. When the polishing brush 1 has the same outer diameter dimension as conventional ones, the grinding element bundle 9 (wire-shaped grinding elements 28) can be increased in length, thereby suppressing the breaking of the wire-shaped grinding elements 28 during work.

In the present embodiment, the shank member 6 and the brush body 10 are separate, and the shank member 6 is removable from the grinding element holder 7. Therefore, when the wire-shaped grinding elements 28 are worn, the brush body 10 alone can be replaced with a new one and the shank member 6 can be reused. In addition, a plurality of shank members 6 having shank portions 5 with different lengths may be prepared so that, by selecting any one of the shank members 6, it is possible to adjust the position of the grinding element bundle 9 relative to the head when the polishing brush 1 is coupled to the head of a machine tool.

The polishing brush 1 in the present embodiment may be rotated in any direction around the axis of center of rotation L as the rotational direction R1 during work.

The grinding element holder 7 may be formed as a single member using, for example, a 3D printer. In this case, an adhesive is injected into the holding holes 20 from the outer periphery to fill the holding holes 20 and the coupling hole 24 with an adhesive. The wire-shaped grinding elements 28 (grinding element bundle 9) are inserted into the holding hole 20 from the outer periphery of the holder body 21 to be fixed to the grinding element holder 7.

Here, the cross-sectional shape of the grinding element bundle 9 may be a rectangle or an oval longer in the top-bottom direction and shorter in the rotational direction R1. In these cases, the holding hole 20 as viewed from the radial direction M is shaped in a rectangle or an oval inclined upward or downward in the rotational direction R1. The grinding element bundle 9 is then held in this holding hole 20 so that the front surface and the back surface of the grinding element bundle 9 are inclined relative to the virtual surface 30. Here, when the cross section of the grinding element bundle 9 has an oval shape, the state in which the front surface and the back surface of the grinding element bundle 9 are inclined relative to the virtual surface 30 refers to a state in which the longer axis in the oval cross section is inclined backward in the rotational direction R1 from one side toward the other side in the direction of the axis of center of rotation L whereby the front surface and the back surface of the grinding element bundle 9 are each inclined relative to the virtual surface 30.

(Second Embodiment)

Figure 5A:
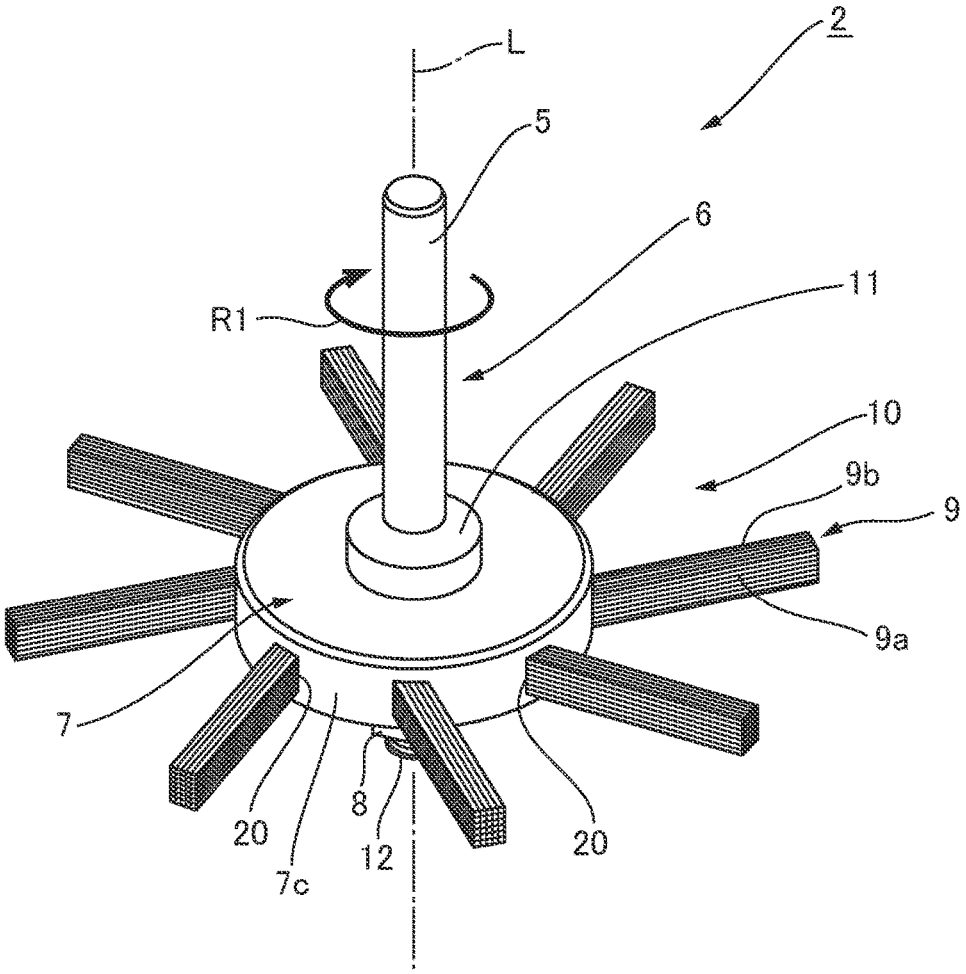
FIG. 5 is an illustration of a polishing brush and a brush body in a second embodiment.
Figure 5B:
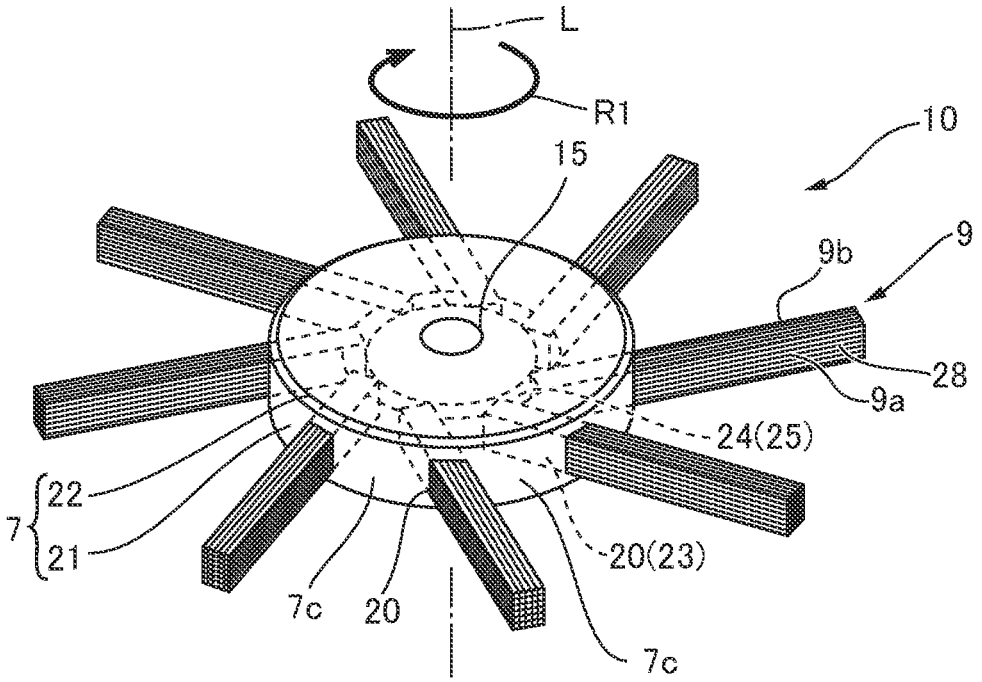

FIG. 5(*a*) is a perspective view of a polishing brush according to a second embodiment of the present invention as viewed diagonally from above and FIG. 5(*b*) is a perspective view of the brush body 10 of the polishing brush in FIG. 5(*a*) as viewed diagonally from above. The polishing brush 2 in the second embodiment has a configuration corresponding to the polishing brush 1 in the first embodiment, and the corresponding parts are denoted with the same reference signs and will not be further elaborated.

As shown in FIG. 5(*a*), the polishing brush 2 includes a shank member 6 having a shank portion (shank) 5 coupled to the head of a machine tool (drive device), an annular grinding element holder 7 through which the lower portion of the shank member 6 passes, and a locknut 8 screwed on the lower end portion of the shank member 6. A plurality of grinding element bundles 9 protrude from the grinding element holder 7 toward the outer periphery. The shank member 6 and the locknut 8 are made of metal, and the grinding element holder 7 is made of resin. Each of the grinding element bundles 9 is formed with a bundle of a plurality of wire-shaped grinding elements 28 formed by impregnating and solidifying an assembly of inorganic filaments with resin. The grinding element bundles 9 have the identical length. The grinding element holder 7 and the grinding element bundles 9 constitute the brush body 10. In the polishing brush 2 in the present embodiment, the direction of rotation during work is defined as the rotational direction R1.

The shank member 6 includes a shank portion 5, a collar 11, and a bolt 12 from the top to the bottom. The portion below the collar 11 of the shank member 6 is inserted into the center hole 15 in the grinding element holder 7, and the lower end portion of the bolt 12 protrudes downward from the grinding element holder 7.

The annular outer peripheral side surface 7*c* of the grinding element holder 7 is the grinding element-holding surface. On the outer peripheral side surface 7*c*, a plurality of holding holes 20 holding the grinding element bundles 9 are formed at regular angular intervals in an annular shape. When the grinding element holder 7 is viewed from the radial direction M, each of the holding holes 20 is shaped in a rectangle longer in the direction of the axis of center of rotation L and shorter in the circumferential direction. The grinding element holder 7 has a rotation-symmetric shape that is identical when turned upside down.

As shown in FIG. 5(*b*), each of the holding holes 20 is recessed in the direction inclined relative to the radial direction M. That is, each of the holding holes 20 is inclined forward in the rotational direction R1 toward inner periphery. The grinding element holder 7 also has a coupling hole 24, which connects the inner peripheral end portions of the holding holes 20. The coupling hole 24 is provided concentrically with the center hole 15 in the grinding element holder 7 and has the same height as each of the holding holes 20. The holding holes 20 and the coupling hole 24 have minute projections and depressions on their inner wall surfaces. Here, the grinding element holder 7 is constituted with a holder body 21 and a cover 22 as in the first embodiment, and the holder body 21 has holding grooves 23 serving as the holding holes 20 and a coupling groove 25 serving as the coupling hole 24.

The inner peripheral end portion of the grinding element bundle 9 is inserted in the holding hole 20 and fixed to the grinding element holder 7 with an adhesive. When the grinding element bundle 9 is to be fixed to the holding hole 20, the holding grooves 23 and the coupling groove 25 of the holder body 21 are filled with an adhesive. An adhesive is applied also on the upper end surface of the holder body 21. Next, the wire-shaped grinding elements 28 with the identical length are held in the form of a bundle using a jig, and the inner peripheral end portions of the wire-shaped grinding elements 28 are inserted from above or from the outer periphery into the holding groove 23. Subsequently, the cover 22 is put on the holder body 21 and the adhesive is hardened. In this way, while the grinding element bundle 9 is formed, this grinding element bundle 9 is fixed to the grinding element holder 7.

Figure 6:
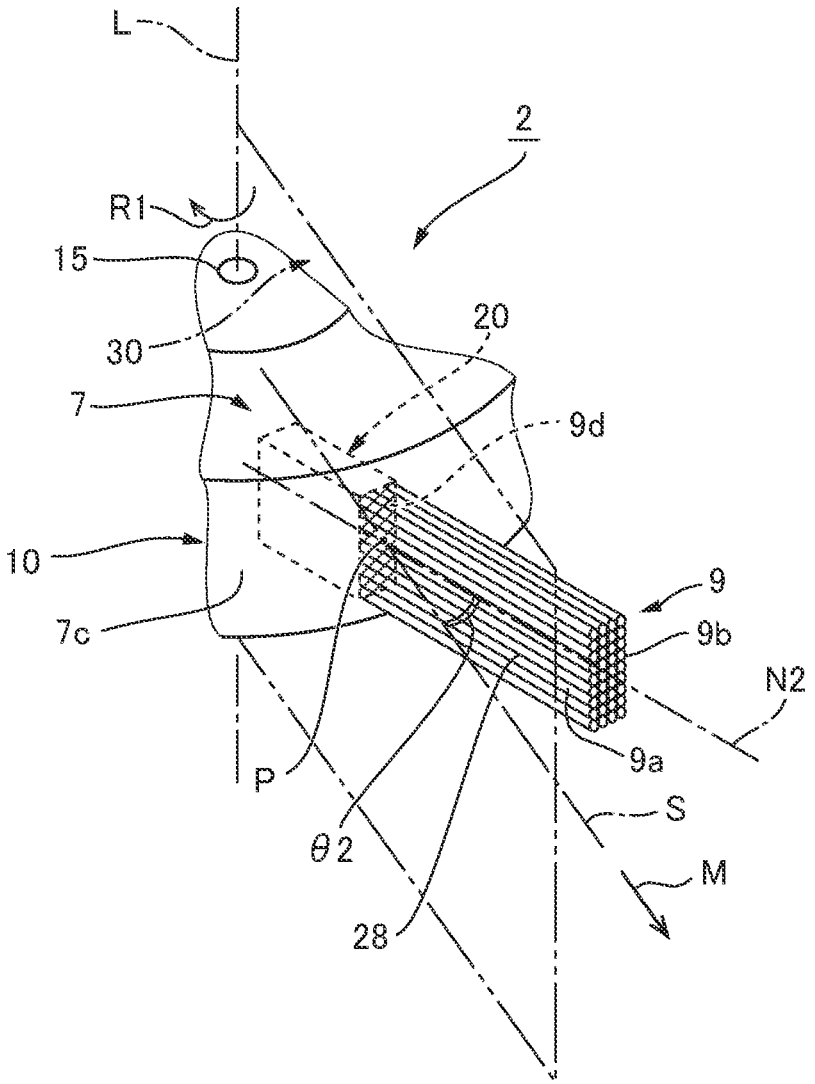
FIG. 6 is a partial enlarged view of the brush body of the polishing brush in the second embodiment.

Here, inserting the grinding element bundle 9 into the holding hole 20 allows the grinding element bundle 9 to have a cross-sectional shape corresponding to the cross-sectional shape of the holding hole 20. That is, the grinding element bundle 9 has a rectangular cross-sectional shape and has a front surface 9*a* facing forward in the rotational direction R1 and a back surface 9*b*. FIG. 6 is a partial enlarged view of the brush body 10. In FIG. 6, the coupling hole 24 is not shown to facilitate understanding of the shape of the holding hole 20.

As shown in FIG. 6, the front surface 9*a* and the back surface 9*b* each extend along the wire-shaped grinding element 28 from the inner periphery to the outer periphery and extend in the top-bottom direction. The front surface 9*a* and the back surface 9*b* are parallel to each other, and the thickness dimension of the grinding element bundle 9 is constant in the circumferential direction. The cross-sectional shape (the cross-sectional shape orthogonal to the direction in which the wire-shaped grinding elements 28 extend) of the grinding element bundle 9 is a rectangle that has a smaller thickness dimension in the circumferential direction than the height in the direction of the axis of center of rotation L.

Since each of the holding holes 20 is inclined relative to the radial direction M, insertion of the grinding element bundle 9 into the holding hole 20 allows the grinding element bundle 9 to be inclined by a predetermined inclination angle θ2. In the present embodiment, the grinding element bundle 9 is inclined backward in the rotational direction R1 from the inner periphery toward the outer periphery by the inclination angle θ2, relative to a virtual surface 30 that includes the center point P of a cross section 9*d* of the grinding element bundle 9 cut across the grinding element bundle-holding surface (outer peripheral side surface 7*c*) and the axis of center of rotation L and extends in the radial direction M. In other words, the center line N2 of the grinding element bundle 9 passing through the center point P and extending in the middle between the front surface 9*a* and the back surface 9*b* from the inner periphery toward the outer periphery is inclined relative to the virtual surface 30 (relative to the virtual line S passing through the center point P on the virtual surface 30 and extending in the radial direction M) by the inclination angle θ2. Therefore, the front surface 9*a* and the back surface 9*b* of the grinding element bundle 9 are also inclined relative to the virtual surface 30 backward in the rotational direction R1 from the inner periphery toward the outer periphery. In the present embodiment, the inclination angle θ2 is 30°.

The locknut 8 is screwed from below on the lower end portion of the bolt 12 protruding downward from the grinding element holder 7 and holds the grinding element holder 7 together with the collar 11 of the shank member 6.

(Work Operation)

Figure 7:
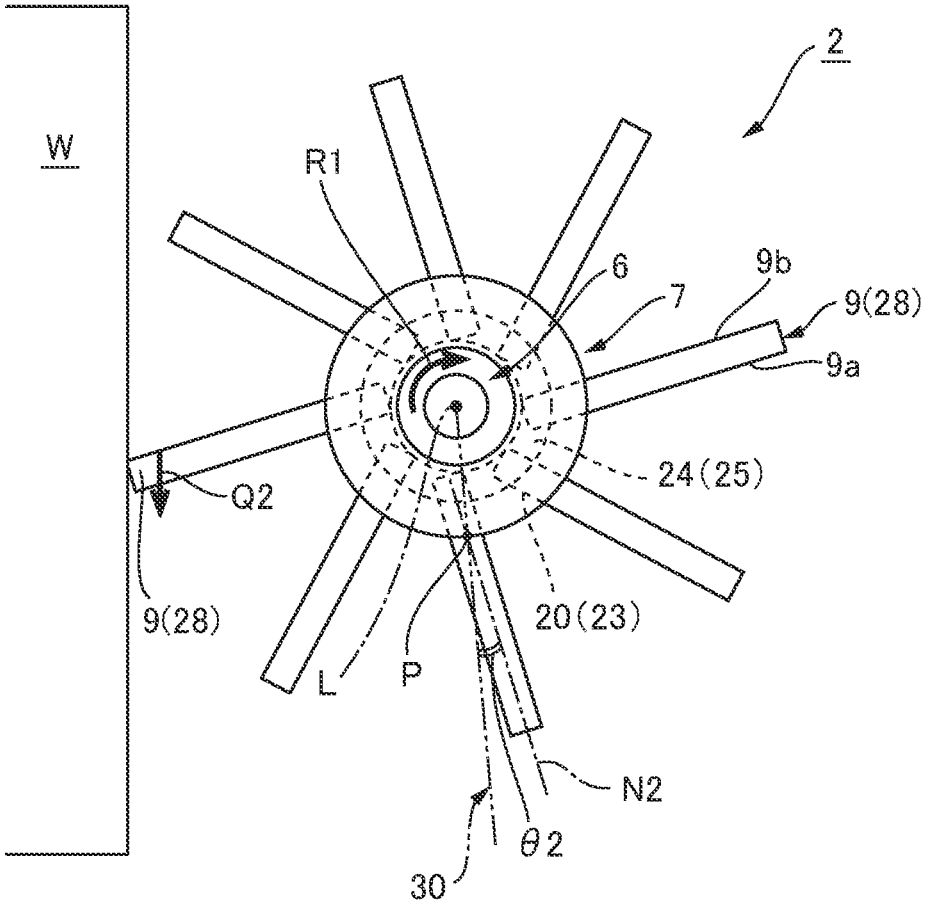
FIG. 7 is an illustration of work operation by the polishing brush in the second embodiment.

FIG. 7 is an illustration of work operation by the polishing brush 2 in the present embodiment. In FIG. 7, the front side in the drawing is the top side of the polishing brush 2, and the back side is the bottom side. When burring or grinding/polishing work on a surface is performed on a workpiece W using the polishing brush 2, the polishing brush 2 is rotated with the shank portion 5 coupled to the drive device of a grinder, and the tip ends (the ends in the outer periphery) of the wire-shaped grinding elements 28 (grinding element bundle 9) are pressed against the surface of the workpiece W. During work, the polishing brush 2 is rotated in the rotational direction R1 in which the front surface 9*a* of the grinding element bundle 9 is inclined backward from the inner periphery toward the outer periphery.

Here, in the present embodiment, the surfaces facing in the circumferential direction (the front surface 9*a* and the back surface 9*b*) in the grinding element bundle 9 are inclined relative to the virtual surface 30 including the axis of center of rotation L. Therefore, compared with a case in which the end surfaces 9*a* and 9*b* are parallel to the virtual surface 30 (orthogonal to the rotational direction R1), the wire-shaped grinding elements 28 included in the grinding element bundle 9 are easily displaced backward in the rotational direction R1 (the direction shown by the arrow Q2 in FIG. 7) when the polishing brush 1 is rotated and the tip end of the grinding element bundle 9 is pressed against a workpiece W. Therefore, when excessive force is applied to the wire-shaped grinding elements 28, the force can be released. This can suppress the breaking of the wire-shaped grinding elements 28.

The inclination angle θ2 relative to the virtual surface 30 of the center line N2 of the grinding element bundle 9 passing through the center point P and extending from the inner periphery toward the outer periphery in the middle between the front surface 9*a* and the back surface 9*b* is preferably in the range of 10° or more to 60° or less. With this range of the inclination angle θ2, it is possible to suppress the breaking of the wire-shaped grinding elements 28 while suppressing reduction of the capability of the grinding element bundle 9 cutting a workpiece W.

Also in the present embodiment, since the grinding element holder 7 holding the inner peripheral end portion of the grinding element bundle 9 is made of resin, the flexibility of the resin can absorb excessive force applied to the wire-shaped grinding elements 28. Also in the present embodiment, the adjacent grinding element bundles 9 are affixed to each other with an adhesive injected in the coupling hole 24 to ensure that the grinding element bundles 9 are fixed to the grinding element holder 7. In addition, since the holding holes 20 and the coupling hole 24 to be filled with an adhesive have projections and depressions on their inner peripheral surfaces, the anchor effect ensures that the grinding element bundles 9 are fixed to the grinding element holder 7.

Also in the present embodiment, the shank member 6 and the brush body 10 are separate, and the shank member 6 is removable from the grinding element holder 7. Thus, the brush body 10 alone can be replaced with a new one. In addition, a plurality of shank members 6 having shank portions 5 with different lengths may be prepared so that, by selecting any one of the shank members 6, it is possible to adjust the position of the grinding element bundle 9 relative to the head when the polishing brush 2 is coupled to the head of a machine tool.

Here, the cross-sectional shape of the grinding element bundle 9 may be an oval longer in the top-bottom direction and shorter in the rotational direction R1. Also in this case, the base end portion of the grinding element bundle 9 is held in the holding hole 20 inclined relative to the radial direction M, whereby the front surface and the back surface of the grinding element bundle 9 each can be inclined backward in the rotational direction R1 from the inner periphery toward the outer periphery. In the present embodiment, the cross-sectional shape of the grinding element bundle 9 may be a circle. Also when the cross-sectional shape of the grinding element bundle 9 is a circle, the base end portion of the grinding element bundle 9 is held in the holding hole 20 inclined relative to the radial direction M, whereby the front surface and the back surface of the grinding element bundle 9 each can be inclined backward in the rotational direction R1 from the inner periphery toward the outer periphery. In any case, the breaking of the wire-shaped grinding elements 28 can be suppressed during work.

(Modification to First Embodiment and Second Embodiment)

In the first embodiment, the grinding element bundle 9 may be held in the grinding element holder 7 in a state in which it is inclined in the circumferential direction relative to the virtual surface 30. That is, each of the holding holes 20 in the grinding element holder 7 in the first embodiment is recessed in the direction inclined forward in the rotational direction R1 relative to the radial direction M, in the same manner as each of the holding holes 20 in the second embodiment. The grinding element bundle 9 is then held in each of the holding holes 20 whereby the front surface 9*a* and the back surface 9*b* of the grinding element bundle 9 are inclined backward in the rotational direction R1 from the inner periphery toward the outer periphery. In this way, when excessive force is applied, the wire-shaped grinding elements 28 are easily displaced in the direction of the axis of center of rotation L and backward in the rotational direction R1. This further suppresses the breaking of the wire-shaped grinding elements 28.

(Third Embodiment)

Figure 8:
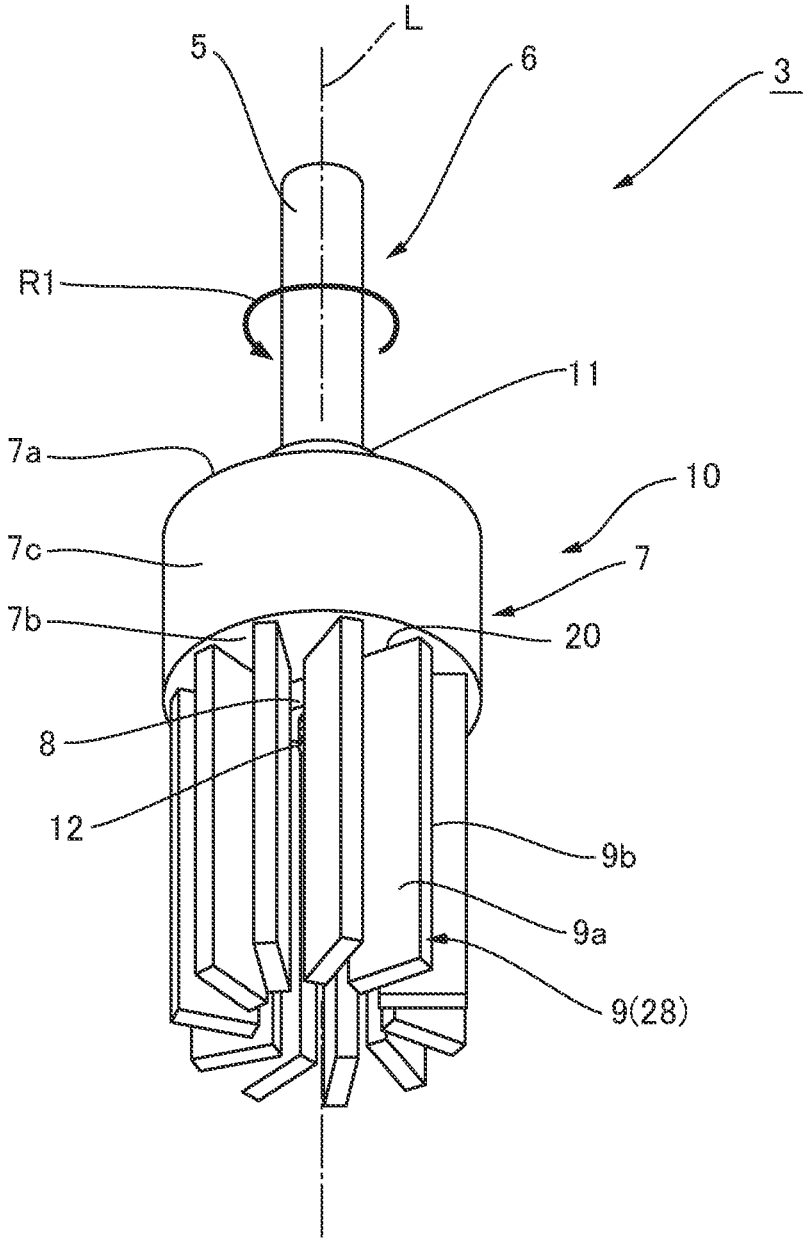
FIG. 8 is a perspective view of a polishing brush in a third embodiment.
Figure 9A:
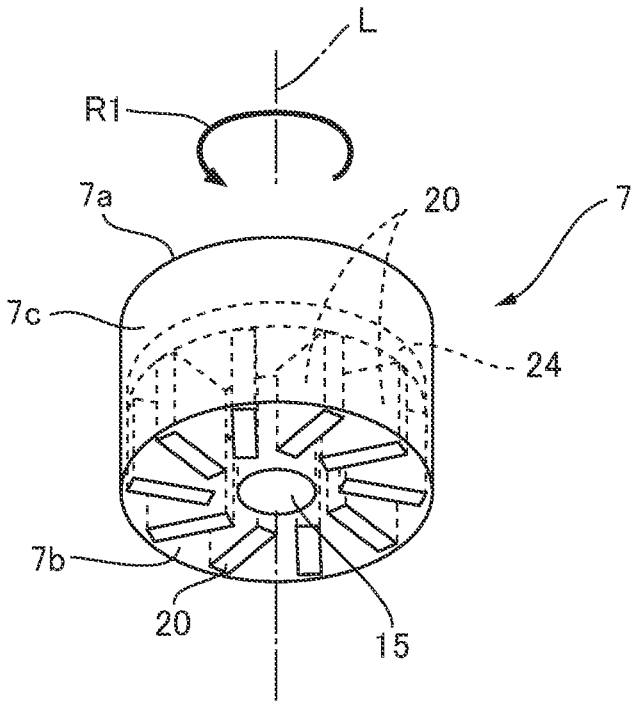
FIG. 9 includes a perspective view and a sectional view of the grinding element holder of the polishing brush in the third embodiment.
Figure 9B:
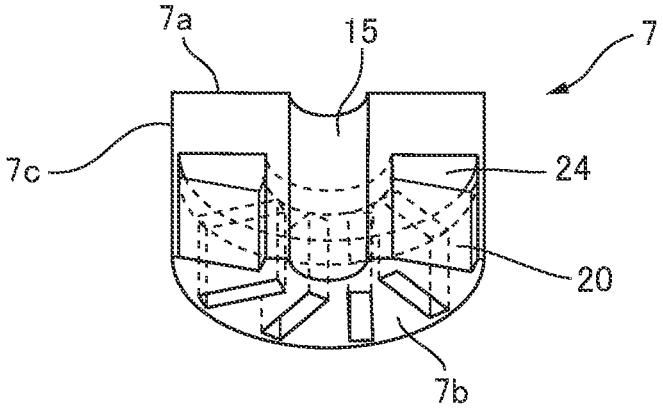
Figure 10:
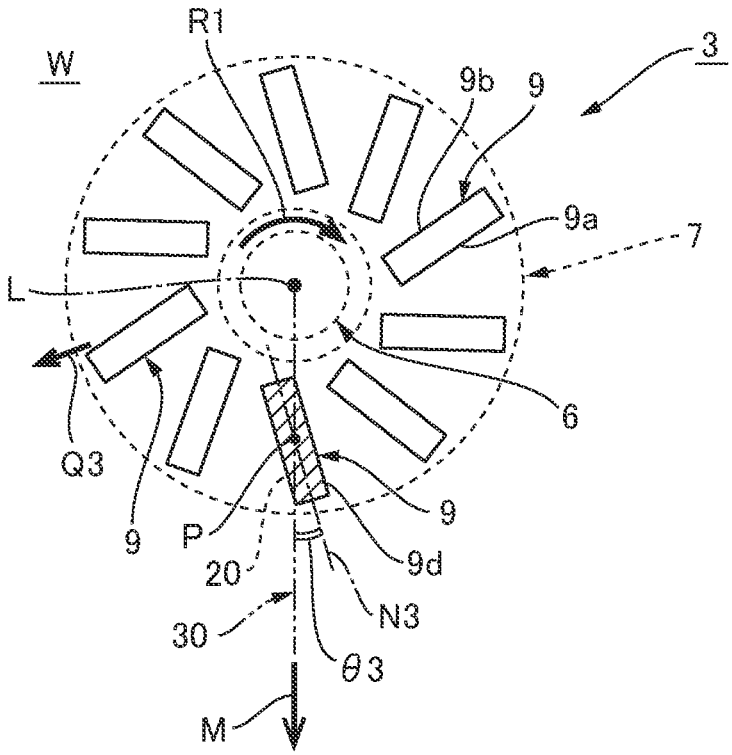
FIG. 10 is an illustration of work operation by the polishing brush in the third embodiment.

FIG. 8 is a perspective view of a polishing brush according to a third embodiment of the present invention as viewed diagonally from below. FIG. 9(*a*) is a perspective view of the grinding element holder as viewed from below and FIG. 9(*b*) is a longitudinal sectional view of the grinding element holder. FIG. 10 is an illustration of work operation by the polishing brush 3 in the present embodiment. FIG. 10 shows the polishing brush 3 as viewed from the shank portion 5 side in the direction of the axis of center of rotation L, in which the shank member 6 and the grinding element holder 7 are shown by dotted lines. In FIG. 10, the front side in the drawing is the top side of the polishing brush 2 and the back side is the bottom side. Here, the polishing brush 3 in the third embodiment has a configuration corresponding to the polishing brush 1 in the first embodiment, and the corresponding parts are denoted with the same reference signs and will not be further elaborated. In the polishing brush 3 in the present embodiment, the direction of rotation during polishing/grinding work is not defined, as is the case with the polishing brush 1 in the first embodiment. For the sake of convenience, it is assumed that the direction shown by the arrow in FIG. 8 is the rotational direction R1.

As shown in FIG. 8, the polishing brush 3 includes a shank member 6 having a shank portion (shank) 5 coupled to the head of a machine tool (drive device), an annular grinding element holder 7 through which the lower portion of the shank member 6 passes, and a locknut 8 screwed on the lower end portion shank member 6. A plurality of grinding element bundles 9 protrude from the lower end surface 7*b* of the grinding element holder 7 in the direction of the axis of center of rotation L. The shank member 6 and the locknut 8 are made of metal, and the grinding element holder 7 is made of resin. Each of the grinding element bundles 9 is a bundle of a plurality of wire-shaped grinding elements 28 formed by impregnating and solidifying an assembly of inorganic filaments with resin. The wire-shaped grinding elements 28 have the identical length. The grinding element holder 7 and the grinding element bundles 9 constitute the brush body 10.

The shank member 6 includes a shank portion 5, a collar 11, and a bolt 12 from the top to the bottom. The portion below the collar 11 of the shank member 6 is inserted in the center hole 15 in the grinding element holder 7 (see FIG. 7), and the lower end portion of the bolt 12 protrudes downward from the grinding element holder 7.

As shown in FIG. 9(*a*), the annular lower end surface 7*b* of the grinding element holder 7 is the grinding element-holding surface, on which a plurality of holding holes 20 holding the grinding element bundles 9 are formed at regular angular intervals in an annular shape. Each of the holding holes 20 is recessed in the direction of the axis of center of rotation L. When the grinding element holder 7 is viewed from the direction of the axis of center of rotation L, the holding hole 20 is shaped in a rectangle longer in the radial direction M and shorter in the circumferential direction and is inclined relative to the radial direction M. That is, the holding hole 20 has a rectangular cross-sectional shape inclined backward in the rotational direction R1 of the polishing brush 3 toward the outer periphery.

As shown in FIG. 9(*b*), the grinding element holder 7 also has a coupling hole 24, which connects the upper end portions of the holding holes 20. The coupling hole 24 is annular and provided concentrically with the center hole 15 in the grinding element holder 7. The holding holes 20 and the coupling hole 24 have minute projections and depressions on their inner wall surfaces.

As shown in FIG. 8, the upper end portion of the grinding element bundle 9 is inserted in the holding hole 20 and fixed to the grinding element holder 7 with an adhesive. When the grinding element bundle 9 is to be fixed to the holding hole 20, the holding holes 20 and the coupling hole 24 in the holder body 21 are filled with an adhesive. Next, the wire-shaped grinding elements 28 with the identical length are held in the form of a bundle using a jig and the upper end portions of the wire-shaped grinding elements 28 are inserted into the holding hole 20. In this way, while the grinding element bundle 9 is formed, this grinding element bundle 9 is fixed to the grinding element holder 7.

Here, inserting the grinding element bundle 9 into the holding hole 20 allows the grinding element bundle 9 to have a cross-sectional shape corresponding to the cross-sectional shape of the holding hole 20. That is, the grinding element bundle 9 has a rectangular cross-sectional shape and has a front surface 9*a* facing forward in the rotational direction R1 and a back surface 9*b*. The front surface 9*a* and the back surface 9*b* each extend along the wire-shaped grinding elements 28 in the top-bottom direction and extend from the inner periphery to the outer periphery. The front surface 9*a* and the back surface 9*b* are parallel to each other, and the thickness dimension of the grinding element bundle 9 is constant in the circumferential direction. The cross-sectional shape (the cross-sectional shape orthogonal to the direction in which the wire-shaped grinding elements 28 extend) of the grinding element bundle 9 is a flattened shape that has a smaller thickness dimension in the circumferential direction than the length from the inner periphery toward the outer periphery.

As shown in FIG. 10, since each of the holding holes 20 is inclined relative to the radial direction M, the grinding element bundle 9 is inclined backward in the rotational direction R1 from the inner periphery toward the outer periphery of the radial direction M by an inclination angle θ3, relative to a virtual surface 30 that includes the center point P of a cross section 9*d* of the grinding element bundle 9 cut across the grinding element bundle-holding surface (lower end surface 7*b*) and the axis of center of rotation L and extends in the radial direction M. In other words, the center line N3 of the grinding element bundle 9 passing through the center point P and extending in the middle between the front surface 9*a* and the back surface 9*b* from the inner periphery toward the outer periphery is inclined relative to the virtual surface 30 by the inclination angle θ3. Therefore, the front surface 9*a* and the back surface 9*b* of the grinding element bundle 9 are also inclined backward in the rotational direction R1 from the inner periphery toward the outer periphery relative to the virtual surface 30. In the present embodiment, the inclination angle θ3 is 30°.

The locknut 8 is screwed from below onto the lower end portion of the bolt 12 protruding downward from the grinding element holder 7 and holds the grinding element holder 7 together with the collar 11 of the shank member 6.

(Work Operation)

When burring or grinding/polishing work on a surface is performed on a workpiece W using the polishing brush 3, the polishing brush 3 is rotated with the shank portion 5 coupled to the drive device of a grinder, and the tip ends (lower ends) of the wire-shaped grinding elements 28 (grinding element bundle 9) are pressed against the surface of the workpiece W. As shown in FIG. 10, during work, the polishing brush 3 is rotated such that the front surface 9*a* of the grinding element bundle 9 is inclined backward in the rotational direction R1 from the inner periphery toward the outer periphery.

Here, in the present embodiment, the front surface 9*a* and the back surface 9*b* of the grinding element bundle 9 are inclined relative to the virtual surface 30 including the axis of center of rotation L. Therefore, compared with a case in which the front surface 9*a* and the back surface 9*b* are parallel to the virtual surface 30 (orthogonal to the rotational direction R1), the wire-shaped grinding elements 28 included in the grinding element bundle 9 are easily displaced toward the outer periphery (the direction shown by the arrow Q3 in FIG. 10) when the polishing brush 1 is rotated and the tip end of the grinding element bundle 9 is pressed against a workpiece W. Therefore, when excessive force is applied to the wire-shaped grinding elements 28, the force can be released. This can suppress the breaking of the wire-shaped grinding elements 28.

The inclination angle θ3 relative to the virtual surface 30 of the center line N3 of the grinding element bundle 9 passing through the center point P and extending from the inner periphery toward the outer periphery in the middle between the front surface 9*a* and the back surface 9*b* is preferably in the range of 20° or more to 60° or less. With this range of the inclination angle θ, it is possible to suppress the breaking of the wire-shaped grinding elements 28 while suppressing reduction of the capability of the grinding element bundle 9 cutting a workpiece W.

Also in the present embodiment, since the grinding element holder 7 holding the upper end portion of the grinding element bundle 9 is made of resin, the flexibility of the resin can absorb excessive force applied to the wire-shaped grinding elements 28. The adjacent grinding element bundles 9 are affixed to each other with an adhesive injected in the coupling hole 24 to ensure that the grinding element bundles 9 are fixed to the grinding element holder 7. In addition, since the holding holes 20 and the coupling hole 24 to be filled with an adhesive have projections and depressions on their inner wall surfaces, the anchor effect ensures that the grinding element bundles 9 are fixed to the grinding element holder 7. As a result, the dimension of the holding hole 20 can be reduced in the depth direction, so that the size of the grinding element holder 7 can be reduced in the direction of the axis of center of rotation L. When the polishing brush 1 has the same height as conventional ones, the grinding element bundle 9 (wire-shaped grinding elements 28) can be increased in length, thereby suppressing the breaking of the wire-shaped grinding elements 28 during work.

Also in the present embodiment, the shank member 6 and the brush body 10 are separate, and the shank member 6 is removable from the grinding element holder 7. Therefore, the brush body 10 alone can be replaced with a new one. In addition, a plurality of shank members 6 having shank portions 5 with different lengths may be prepared so that, by selecting any one of the shank members 6, it is possible to adjust the position of the grinding element bundle 9 relative to the head when the polishing brush 3 is coupled to the head of a machine tool.

Here, the cross-sectional shape of the grinding element bundle 9 may be an oval longer in the radial direction M and shorter in the rotational direction R1. In this case, the holding hole 20 as viewed from the direction of the axis of center of rotation L is shaped in an oval inclined in the rotational direction R1 from the inner periphery toward the outer periphery. The grinding element bundle 9 is then held in this holding hole 20 whereby the front surface and the back surface of the grinding element bundle 9 are inclined relative to the virtual surface 30. Here, when the cross section of the grinding element bundle 9 has an oval shape, the state in which the front surface and the back surface of the grinding element bundle 9 are inclined relative to the virtual surface 30 refers to a state in which the longer axis in the oval cross section is inclined backward in the rotational direction R1 from the inner periphery toward the outer periphery whereby the front surface and the back surface of the grinding element bundle 9 are each inclined relative to the virtual surface 30.

(Fourth Embodiment)

Figure 11A:
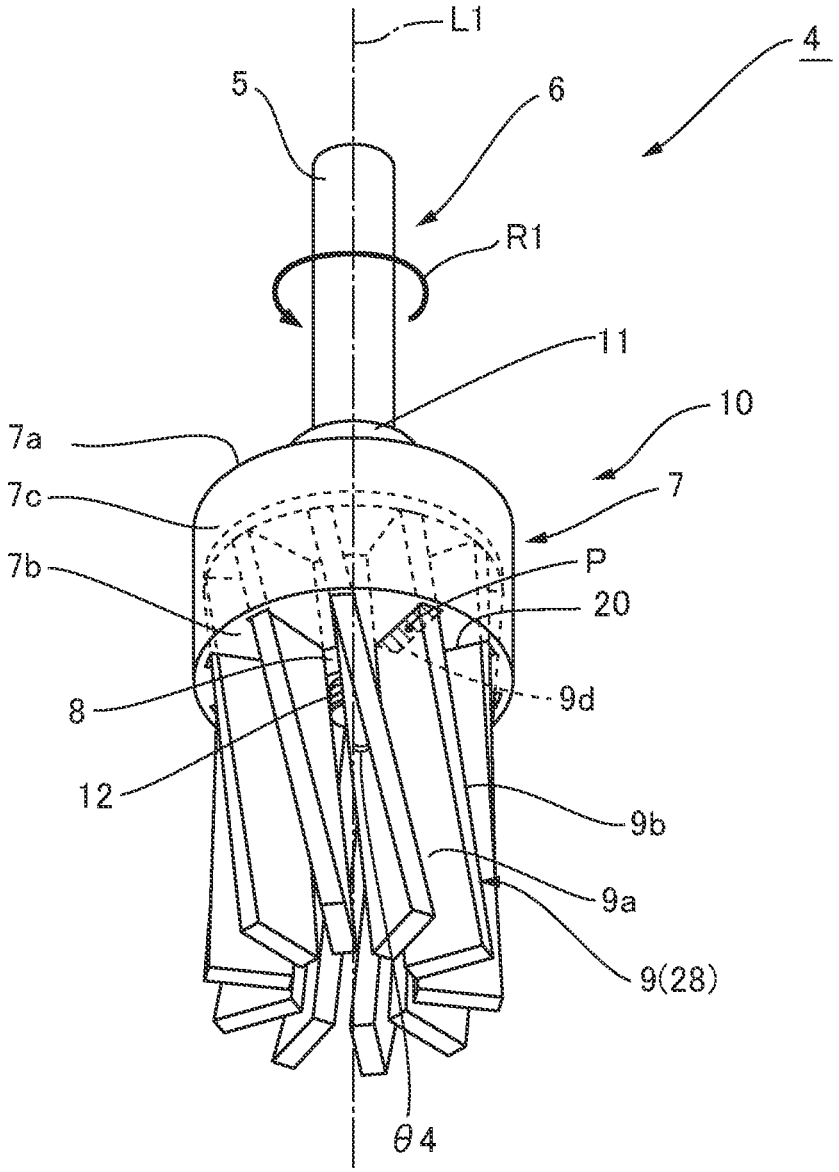
FIG. 11 is an illustration of a polishing brush in a fourth embodiment.
Figure 11B:
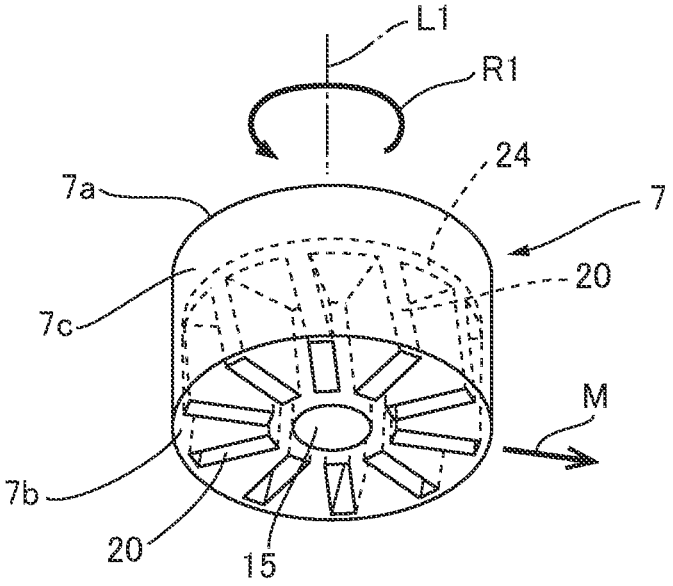
Figure 12:
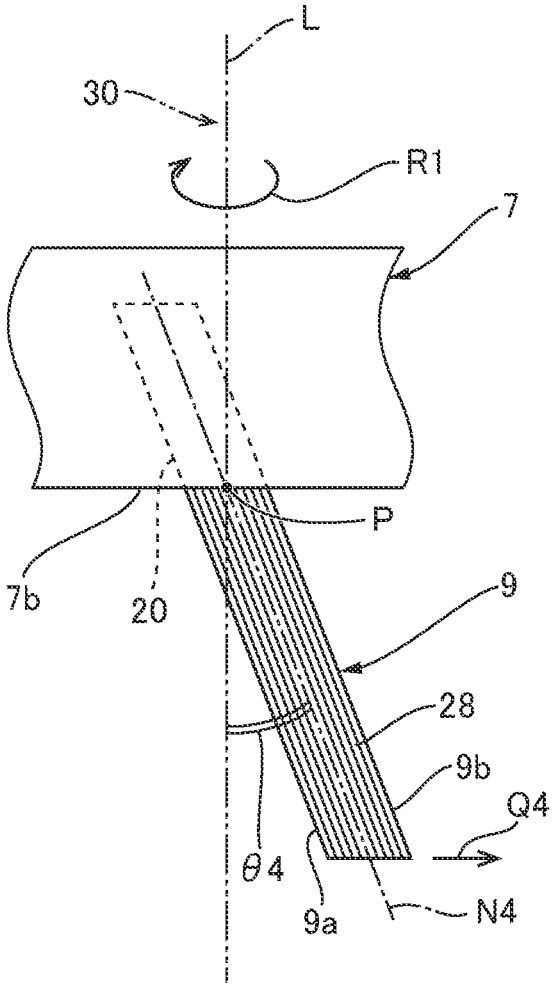
FIG. 12 is a partial enlarged view of the brush body of the polishing brush in the fourth embodiment.

FIG. 11(*a*) is a perspective view of a polishing brush according to a fourth embodiment of the present invention as viewed diagonally from below and FIG. 11(*b*) is a perspective view of the grinding element holder 7 as viewed diagonally from below. FIG. 12 is a partial enlarged view of the brush body 10 as viewed from the radial direction M. In FIG. 12, the coupling hole 24 is not shown to facilitate understanding of the shape of the holding hole 20. The polishing brush 4 in the fourth embodiment has a configuration corresponding to the polishing brush 3 in the third embodiment, and the corresponding parts are denoted with the same reference signs and will not be further elaborated. In the polishing brush 4 in the present embodiment, however, the direction of rotation during polishing/grinding work is defined as the rotational direction R1 shown by the arrow in FIG. 11.

As shown in FIG. 11(*a*), the polishing brush 4 includes a shank member 6 having a shank portion (shank) 5 coupled to the head of a machine tool (drive device), an annular grinding element holder 7 through which the lower portion of the shank member 6 passes, and a locknut 8 screwed on the lower end portion of the shank member 6. A plurality of grinding element bundles 9 protrude from the lower end surface 7*b* of the grinding element holder 7 in the direction of the axis of center of rotation L. The shank member 6 and the locknut 8 are made of metal, and the grinding element holder 7 is made of resin. Each of the grinding element bundles 9 is formed of a bundle of a plurality of wire-shaped grinding elements 28 formed by impregnating and solidifying an assembly of inorganic filaments with resin. The grinding element holder 7 and the grinding element bundles 9 constitute the brush body 10.

The shank member 6 includes a shank portion 5, a collar 11, and a bolt 12 from the top to the bottom. The portion below the collar 11 of the shank member 6 is inserted in the center hole 15 in the grinding element holder 7 (see FIG. 11(*b*)), and the lower end portion of the bolt 12 protrudes downward from the grinding element holder 7.

The annular lower end surface 7*b* of the grinding element holder 7 is the grinding element-holding surface. On the lower end surface 7*b*, as shown in FIG. 11(*b*), a plurality of holding holes 20 holding the grinding element bundles 9 are formed at regular angular intervals in an annular shape. When the grinding element holder 7 is viewed from the direction of the axis of center of rotation L, each of the holding holes 20 is shaped in a rectangle longer in the radial direction M and shorter in the circumferential direction. In each of the holding holes 20, the opening of the rectangle extends in the radial direction M.

Each of the holding holes 20 is recessed in the direction inclined relative to the direction of the axis of center of rotation L. That is, each of the holding holes 20 is inclined forward in the rotational direction R1 upward in the direction of the axis of center of rotation L. The grinding element holder 7 also has a coupling hole 24, which connects the upper end portions of the holding holes 20. The coupling hole 24 is provided concentrically with the center hole 15 in the grinding element holder 7. The holding holes 20 and the coupling hole 24 have minute projections and depressions on their inner wall surfaces.

As shown in FIG. 11(*a*), the upper end portion of the grinding element bundle 9 is inserted in the holding hole 20 and fixed to the grinding element holder 7 with an adhesive. When the grinding element bundle 9 is to be fixed to the holding hole 20, the holding holes 20 and the coupling hole 24 in the holder body 21 are filled with an adhesive. Next, the wire-shaped grinding elements 28 with the identical length are held in the form of a bundle using a jig, and one end portions of the wire-shaped grinding elements 28 are inserted into the holding groove 23. In this way, while the grinding element bundle 9 is formed, this grinding element bundle 9 is fixed to the grinding element holder 7.

Here, inserting the grinding element bundle 9 into the holding hole 20 allows the grinding element bundle 9 to have a cross-sectional shape corresponding to the cross-sectional shape of the holding hole 20. That is, the grinding element bundle 9 has a rectangular cross-sectional shape and has a front surface 9*a* and a back surface 9*b* facing forward in the rotational direction R1. The front surface 9*a* and the back surface 9*b* each extend along the wire-shaped grinding element 28 from the inner periphery to the outer periphery and extend in the top-bottom direction. The front surface 9*a* and the back surface 9*b* are parallel to each other, and the thickness dimension of the grinding element bundle 9 is constant in the circumferential direction. The cross-sectional shape of the grinding element bundle 9 (the cross-sectional shape orthogonal to the direction in which the wire-shaped grinding elements 28 extend) is a rectangle that has a smaller thickness dimension in the rotational direction R1 than the length in the radial direction M.

Since each of the holding holes 20 is inclined relative to the radial direction M, as shown in FIG. 12, the insertion of the grinding element bundle 9 into the holding hole 20 allows the grinding element bundle 9 to be inclined by a predetermined inclination angle θ4. In the present embodiment, the grinding element bundle 9 is inclined backward in the rotational direction R1 from the top to the bottom relative to a virtual surface 30 (see FIG. 12) that includes the center point P (see FIG. 11(*a*)) of a cross section 9*d* of the grinding element bundle 9 cut across the grinding element bundle-holding surface (lower end surface 7*b*) and the axis of center of rotation L and extends in the radial direction M. In other words, as shown in FIG. 12, the center line N4 of the grinding element bundle 9 passing through the center point P and extending in the middle between the front surface 9*a* and the back surface 9*b* from the top to the bottom is inclined relative to the virtual surface 30 by the inclination angle θ4. Therefore, the front surface 9*a* and the back surface 9*b* of the grinding element bundle 9 are also inclined relative to the virtual surface 30 backward in the rotational direction R1 as the distance from the grinding element holder 7 increases. In the present embodiment, the inclination angle θ4 is 20°.

The locknut 8 is screwed from below on the lower end portion of the bolt 12 protruding downward from the grinding element holder 7 and holds the grinding element holder 7 together with the collar 11 of the shank member 6.

When burring or grinding/polishing work on a surface is performed on a workpiece W using the polishing brush 4, the polishing brush 4 is rotated with the shank portion 5 coupled to the drive device of a grinder, and the tip ends (lower ends) of the wire-shaped grinding elements (grinding element bundle 9) are pressed against the surface of the workpiece W. During work, the polishing brush 4 is rotated such that the front surface 9*a* of the grinding element bundle 9 is inclined backward in the rotational direction R1 toward the tip end.

Here, in the present embodiment, the end surfaces (the front surface 9*a* and the back surface 9*b*) facing in the circumferential direction in the grinding element bundle 9 are inclined relative to the virtual surface 30 including the axis of center of rotation L. Therefore, compared with a case in which the end surfaces 9*a* and 9*b* are parallel to the virtual surface 30 (orthogonal to the rotational direction R1), the wire-shaped grinding elements 28 included in the grinding element bundle 9 are easily displaced backward in the rotational direction R1 (the direction shown by the arrow Q4 in FIG. 12) when the polishing brush 4 is rotated and the tip end of the grinding element bundle 9 is pressed against a workpiece W. Therefore, when excessive force is applied to the wire-shaped grinding elements 28, the force can be released. This can suppress the breaking of the wire-shaped grinding elements 28.

The inclination angle θ4 relative to the virtual surface 30 of the center line N4 of the grinding element bundle 9 passing through the center point P and extending from the top to the bottom in the middle between the front surface 9*a* and the back surface 9*b* is preferably within the range of 5° or more to 20° or less. With this range of the inclination angle θ2, it is possible to suppress the breaking of the wire-shaped grinding elements 28 while suppressing reduction of the capability of the grinding element bundle 9 cutting a workpiece W.

Also in the present embodiment, since the grinding element holder 7 holding the upper end portions of the grinding element bundles 9 are made of resin, the flexibility of the resin can absorb excessive force applied to the wire-shaped grinding elements 28. The grinding element bundles 9 are fixed to the grinding element holder 7 with an adhesive injected to the holding holes 20 and the coupling hole 24. The adjacent grinding element bundles 9 are thus affixed to each other to ensure that the grinding element bundles 9 are fixed to the grinding element holder 7. In addition, since the holding holes 20 and the coupling hole 24 to be filled with an adhesive have projections and depressions on their inner peripheral surfaces, the anchor effect ensures that the grinding element bundles 9 are fixed to the grinding element holder 7. As a result, the dimension of the holding hole 20 can be reduced in the depth direction, so that the size of the grinding element holder 7 can be reduced in the direction of the axis of center of rotation L. When the polishing brush 4 is formed with the same height as conventional ones, the length of the grinding element bundle 9 (wire-shaped grinding elements 28) can be ensured, thereby suppressing the breaking of the wire-shaped grinding elements 28 during work.

Also in the present embodiment, the shank member 6 and the brush body 10 are separate, and the shank member 6 is removable from the grinding element holder 7. Therefore, the brush body 10 alone can be replaced with a new one. In addition, a plurality of shank members 6 having shank portions 5 with different lengths may be prepared so that, by selecting any one of the shank members 6, it is possible to adjust the position of the grinding element bundle 9 relative to the head when the polishing brush 4 is coupled to the head of a machine tool.

Here, the cross-sectional shape of the grinding element bundle 9 may be an oval having a cross-sectional shape longer in the radial direction M and shorter in the rotational direction R1. Also in this case, the base end portion of the grinding element bundle 9 is held in the holding hole 20 inclined in the top-bottom direction, whereby the front surface and the back surface of the grinding element bundle 9 each can be inclined backward in the rotational direction R1 as the distance from the grinding element holder 7 increases. In the present embodiment, the cross-sectional shape of the grinding element bundle 9 may be a circle. Also when the cross-sectional shape of the grinding element bundle 9 is a circle, the base end portion of the grinding element bundle 9 is held in the holding hole 20 inclined in the top-bottom direction, whereby the front surface and the back surface of the grinding element bundle 9 each can be inclined backward in the rotational direction R1 as the distance from the grinding element holder 7 increases. In any case, the breaking of the wire-shaped grinding elements 28 can be suppressed during work.

(Modification to Third Embodiment and Fourth Embodiment)

In the third embodiment, the grinding element bundle 9 may be inclined backward in the rotational direction R1 as the distance from the grinding element holder 7 increases. That is, each of the holding holes 20 in the grinding element holder 7 in the third embodiment is recessed in the direction inclined forward in the rotational direction R1 upward in the direction of the axis of center of rotation L, in the same manner as each of the holding holes 20 in the fourth embodiment. The grinding element bundle 9 is then held in each of the holding holes 20 whereby the front surface 9*a* and the back surface 9*b* of the grinding element bundle 9 are inclined backward in the rotational direction R1 as the distance from the grinding element holder 7 increases. In this way, when excessive force is applied, the wire-shaped grinding elements 28 are easily displaced in the radial direction M and backward in the rotational direction R1. This can further suppress the breaking of the wire-shaped grinding elements 28.

(Modification to Second Embodiment and Fourth Embodiment)

In the polishing brush 2 in the second embodiment and the polishing brush 4 in the fourth embodiment, a threaded portion to be screwed on the bolt 12 of the shank member 6 may be provided on the inner peripheral surface of the center hole 15 in the grinding element holder 7, and the bolt 12 may be screwed into the threaded portion of the center hole 15 to removably couple the shank member 6 with the grinding element holder 7. That is, in the polishing brush 2 in the second embodiment and the polishing brush 4 in the fourth embodiment, the direction of rotation in polishing/grinding work is defined as the rotational direction R1. Therefore, if the direction in which the bolt 12 is screwed in the threaded portion of the center hole 15 is set in an appropriate direction, the rotation of the polishing brush 2, 4 causes neither loosening of the coupling between the shank member 6 and the grinding element holder 7 nor dropping off of the grinding element holder 7 from the shank member 6. Thus, the provision of a threaded portion on the inner peripheral surface of the center hole 15 in the grinding element holder 7 can eliminate the nut 8.

(Other Embodiments)

In the foregoing embodiments, the wire-shaped grinding elements 28 are inserted into the holding holes 20 formed in the grinding element-holding surface (the outer peripheral side surface 7*c* or the lower end surface 7*b*) of the grinding element holder 7, and fixed in the holes with an adhesive to form each of the grinding element bundles 9. Therefore, the shape of each of the holding holes 20 corresponds to the shape of each of the grinding element bundles 9. That is, the shape of each of the holding holes 20 is the same as the shape of the base end portion of the grinding element bundle 9 inserted in the holding hole. In this respect, the holding hole 20 may be a hole larger than the base end portion of the grinding element bundle 9.

In this case, before the wire-shaped grinding elements 28 are inserted into the holding hole 20, the wire-shaped grinding elements 28 are bundled into the grinding element bundle 9 having a predetermined shape and gripped with a jig. Then, when the base end portion of the grinding element bundle 9 is inserted into the holding hole 20 filled with an adhesive, the front surface 9*a* and the back surface 9*b* of the grinding element bundle 9 are postured to be inclined relative to the virtual surface 30 that includes the center point P of the cross section 9*d* of the grinding element bundle 9 inserted in the holding hole 20 cut across the grinding element bundle-holding surface and the axis of center of rotation L and extends in the radial direction M orthogonal to the axis of center of rotation L. The grinding element bundle 9 is thus affixed and fixed with this posture in the holding hole 20. Before the wire-shaped grinding elements 28 are inserted into the holding hole 20, the wire-shaped grinding elements 28 may be bundled into a grinding element bundle 9 having a predetermined shape, and the base end portion of the grinding element bundle 9 may be fixed with an adhesive.

This operation facilitates insertion of the wire-shaped grinding elements 28 into the holding hole 20. Since the front surface 9*a* and the back surface 9*b* of the grinding element bundle 9 held in the holding hole 20 are inclined relative to the virtual surface 30, the breaking of the wire-shaped grinding elements 28 can be suppressed during work.

In the foregoing embodiments, the grinding element-holding surface (the outer peripheral side surface 7*c* or the lower end surface 7*b*) of the grinding element holder 7 have the same number of holding holes 20 as the grinding element bundles 9 to be held by the grinding element holder 7, and the grinding element bundles 9 are held in the holding holes 20. Alternatively, the grinding element-holding surface may have a single annular holding hole 20 in the shape of a groove, and the grinding element bundles 9 may be held apart from each other in this single annular holding hole 20.

In this case, before the wire-shaped grinding elements 28 are inserted into the holding hole 20, the wire-shaped grinding elements 28 are bundled into the grinding element bundle 9 having a predetermined shape and gripped using a jig. The base end portions of the grinding element bundles 9 are then successively inserted at regular intervals into the annular holding hole 20 filled with an adhesive. Here, when the base end portions of the grinding element bundles 9 are inserted into the annular holding hole 20, the front surface 9*a* and the back surface 9*b* of each of the grinding element bundles 9 are postured to be inclined relative to the virtual surface 30 that includes the center point P of the cross section 9*d* of the grinding element bundle 9 inserted in the holding hole 20, cut across the grinding element bundle-holding surface and the axis of center of rotation L and extends in the radial direction M orthogonal to the axis of center of rotation L. In this way, the grinding element bundles 9 are affixed and fixed with this posture at regular intervals in the holding hole 20. The adhesive filling the holding hole 20 is interposed between the adjacent grinding element bundles 9 in the annular holding hole 20. Before the wire-shaped grinding elements 28 are inserted into the holding hole 20, the wire-shaped grinding elements 28 may be bundled into the grinding element bundle 9 having a predetermined shape, and the base end portion of the grinding element bundle 9 may be fixed with an adhesive.

This operation facilitates insertion of the wire-shaped grinding elements 28 into the holding hole 20. Since the front surface 9*a* and the back surface 9*b* of the grinding element bundle 9 held in the holding hole 20 are inclined relative to the virtual surface 30, the breaking of the wire-shaped grinding elements 28 can be suppressed during work.

The invention claimed is:

1. A polishing brush comprising:

grinding element bundles, each of which is formed with a plurality of wire-shaped grinding elements; and a grinding element holder, which has holding holes and holds base end portions of the grinding element bundles in the respective holding holes, wherein at least one of the grinding element bundles has a shape having a longitudinal length and a width smaller than the longitudinal length, in a cross section thereof, which is obtained by cutting the at least one of the grinding element bundles along a virtual plane perpendicular to an axis of center of rotation of the grinding element holder, the holding holes are arranged annularly around the axis of center of rotation of the grinding element holder, the plurality of grinding element bundles extend parallel to the axis of center of rotation of the grinding element holder, and a longitudinal center axis of the shape in the cross section of the at least one of plurality of the grinding element bundles forms an inclination angle with a line, which, on the virtual plane, passes through the axis of center of rotation of the grinding element holder and a center point of the shape in the cross section of the at least one of the plurality of grinding element bundles.

2. The polishing brush according to claim 1, wherein the shape is rectangular or oval.

3. The polishing brush according to claim 1, wherein the grinding element holder is made of resin.

4. The polishing brush according to claim 1, wherein the grinding element holder has a coupling hole connecting the holding holes in a circumferential direction, and each of the grinding element bundles of the wire-shaped grinding elements is fixed to the grinding element holder with an adhesive injected in the corresponding holding hole and the coupling hole.

5. The polishing brush according to claim 1, wherein an inner peripheral surface of the holding hole has projections and depressions.

6. The polishing brush according to claim 1, further comprising a shank removably attached to the grinding element holder.

7. The polishing brush according to claim 1, wherein the inclination angle is in the range of 20° or more to 60° or less.

* * * * *